US006340315B1

(12) United States Patent
Chang

(10) Patent No.: US 6,340,315 B1
(45) Date of Patent: Jan. 22, 2002

(54) BATTERY CONNECTOR ASSEMBLY WITH IMPROVED CONTACTS ARRANGEMENT

(75) Inventor: Jen Jou Chang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/639,391

(22) Filed: Aug. 15, 2000

(30) Foreign Application Priority Data

Jun. 3, 2000 (TW) ..... 089209518

(51) Int. Cl.[7] ..... H01R 24/00
(52) U.S. Cl. ..... 439/660
(58) Field of Search ..... 439/660, 79

(56) References Cited

U.S. PATENT DOCUMENTS 5,904,597 A * 5/1999 Doi et al. ..... 439/660
6,099,356 A * 5/1999 Hwang ..... 439/660
5,971,809 A * 10/1999 Ho ..... 439/660
6,062,892 A * 5/2000 Meng et al. ..... 439/660
6,068,519 A * 5/2000 Lok ..... 439/660

* cited by examiner

*Primary Examiner*—Gary F. Paumen
(74) *Attorney, Agent, or Firm*—Wei Te Chung

(57) ABSTRACT

A battery connector assembly 1 has a plug connector 2 and a receptacle connector 3 mated with each other. The plug and receptacle connectors are similar in structure. Each has an insulative housing 20, 30 and two sets of conductive plug contacts 4, 5 and 7, 8 engaged in each respective housing. Each housing 20, 30 respectively has a side 22, 81 having a step-shaped surface, and forms a lower step 28, 86 and an upper step 25, 88. Each step forms a row of partitions 220, 280, 810, 880 and defines a row of slots 221, 281, 811, 881 separated from each other by the partitions. The row of slots in each lower step is horizontally offset from the row of slots in each upper step. The amount of offset is half a pitch, the pitch being the distance between adjacent contacts. The sets of conductive contacts in the lower and upper steps of the plug connector are mated with complementary sets of contacts in the upper and lower steps of the receptacle connector, respectively. The assembly permits a great number of conductive contacts within a compact space.

1 Claim, 8 Drawing Sheets

BATTERY CONNECTOR ASSEMBLY WITH IMPROVED CONTACTS ARRANGEMENT

FIELD OF THE INVENTION

The present invention relates to a battery connector assembly, and particularly to a battery connector assembly for use with a Personal Digital Assistant (PDA) wherein the battery connector has an improved contacts arrangement.

BACKGROUND OF THE INVENTION

A PDA is a portable device for carrying data and information which can be connected to computers. It is always provided with a battery connector assembly for transmitting electric power between the PDA device and a printed circuit board (PCB). Taiwan patent application Nos. 84210634 and 83107591 disclose similar battery connector assemblies. Referring to FIG. 8, a prior art battery connector assembly comprises a receptacle connector 100 and a plug connector 200 mateable with each other. The receptacle connector 100 comprises an insulative housing 105 and a plurality of conductors 104 engageably received in the housing 105. The housing 105 defines a row of receiving slots 101 opened in top and side walls thereof and forms a row of partitions 102 separating the receiving slots 101 from each other. Each partition 102 defines a recessed opening 103 in one side thereof for receiving a corresponding conductor 104. The plug connector 200 is constructed to correspond with the receptacle connector 100 and comprises an insulative housing 201 and a plurality of conductive plates 202 assembled in the housing 201. In use, the plug connector 200 is mated with the receptacle connector 100 whereby the conductive plates 202 of the plug connector 200 electrically connect with the conductors 104 of the receptacle connector 100 to transmit electrical power and signals between the PCB and the PDA device.

However, developments in computers have resulted in faster and faster signal transmission demands. Electrical circuits in PDA devices are becoming more and more complex. Increasingly, the prior art battery connector assembly, with only a single row of conductors electrically connecting with a single row of conductive plates thereof, cannot adequately handle these faster signal transmission demands.

Hence, an improved battery connector which can provide more conductive contacts to transmit electrical power within a compact space is required to overcome the disadvantages of the prior art.

BRIEF SUMMARY OF THE INVENTION

A main object of the present invention is to provide a battery connector assembly having more contacts than the prior art yet within a compact space.

Another object of the present invention is to provide such an assembly whereby all electrical connections are foolproof, safe and effective.

To fulfil the above-mentioned objects, a battery connector assembly comprises a plug connector and a receptacle connector mating with each other. The plug and receptacle connectors are similar in structure. Each comprises an insulative housing and two sets of conductive contacts engaged in the housing. Each housing comprises a first side having a step-shaped surface which forms a lower step and an upper step. Each step forms a row of partitions and defines a row of slots separated from each other by the partitions. The row of slots in the lower step is horizontally offset from the row of slots in the upper step by a distance equal to half the pitch between adjacent contacts. The slots in each step receive a complementary set of contacts. When the connectors are mated, the sets of conductive contacts in the lower and upper steps of the plug connector are mated with complementary sets of contacts in the upper and lower steps of the receptacle connector, respectively. Thus, compared with the prior art, roughly twice the number of conductive contacts are available in a given connector length for transmitting electrical power and signals. Furthermore, effective and safe electrical connection is achieved due to the horizontal and vertical offset between contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
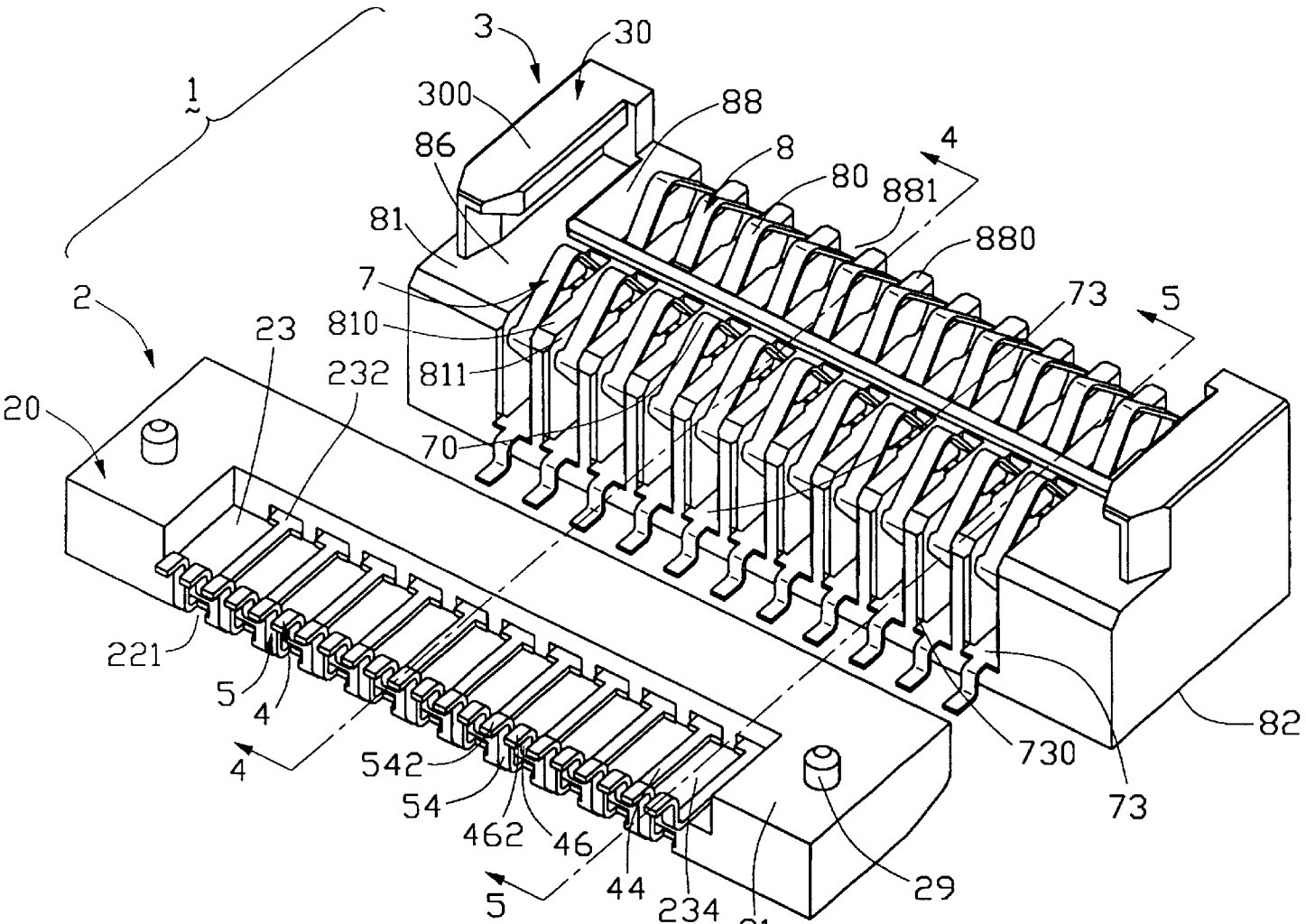
FIG. 1 is a perspective view of a plug connector and a receptacle connector of the present invention.
Figure 2:
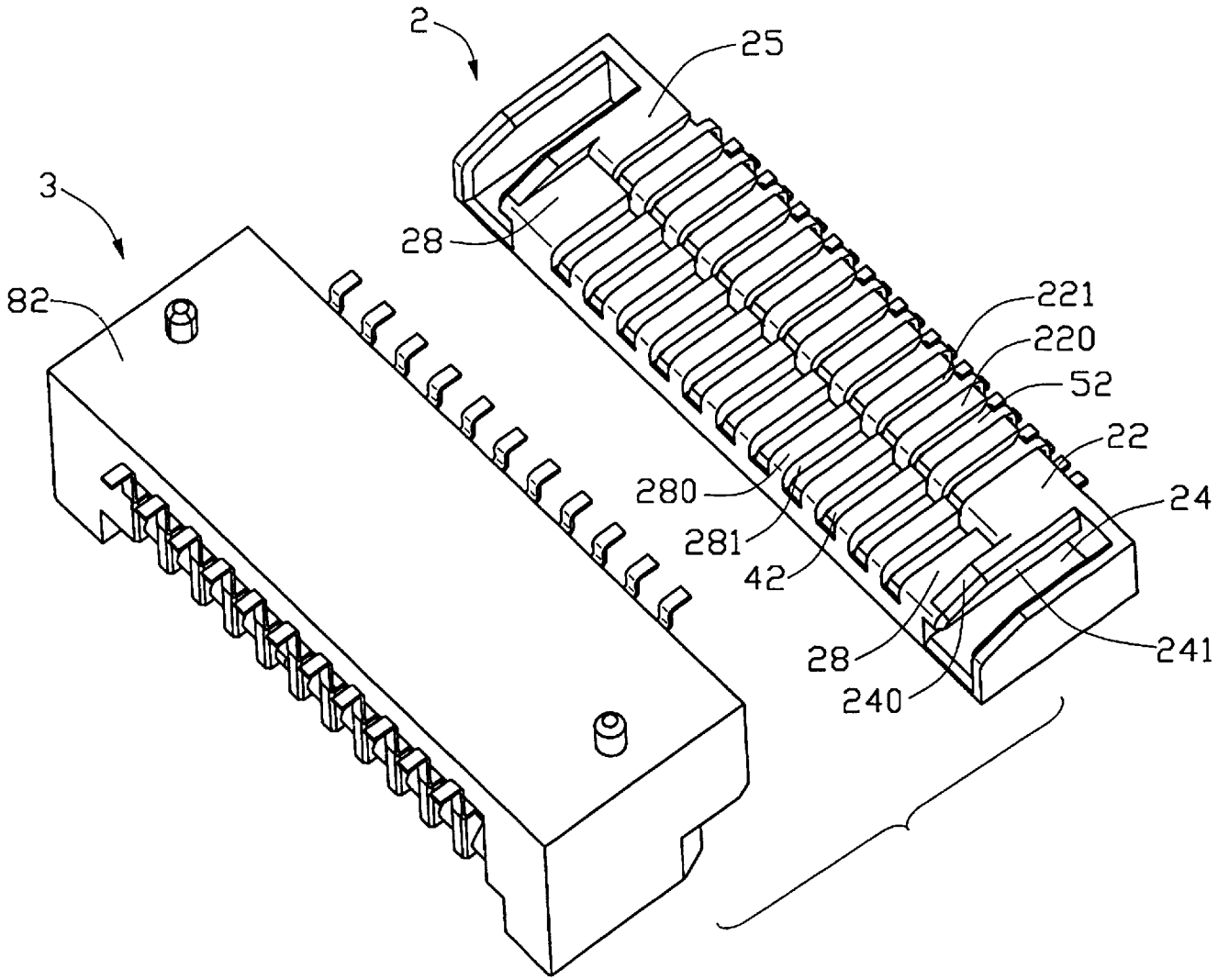
FIG. 2 is similar to FIG. 1 but taken from a bottom aspect.
Figure 3:
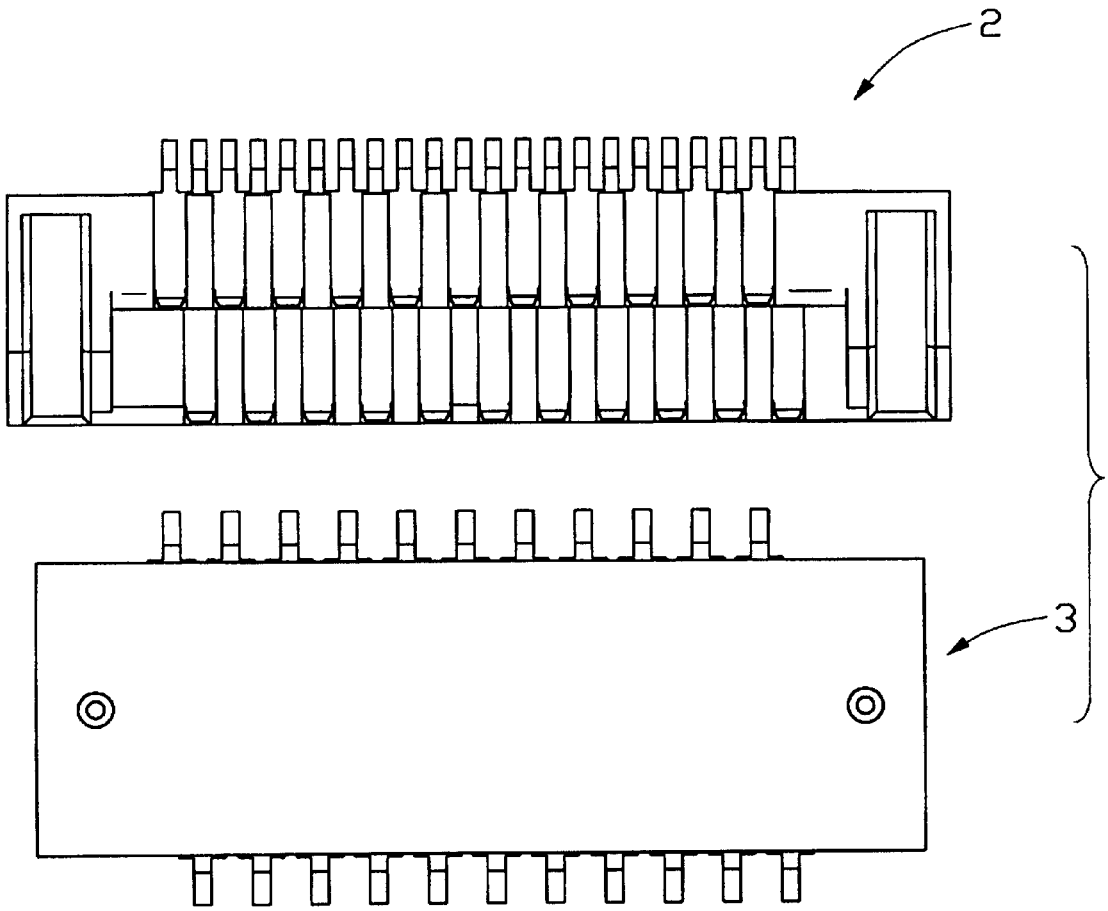
FIG. 3 is a top planar view of FIG. 2.
Figure 4:
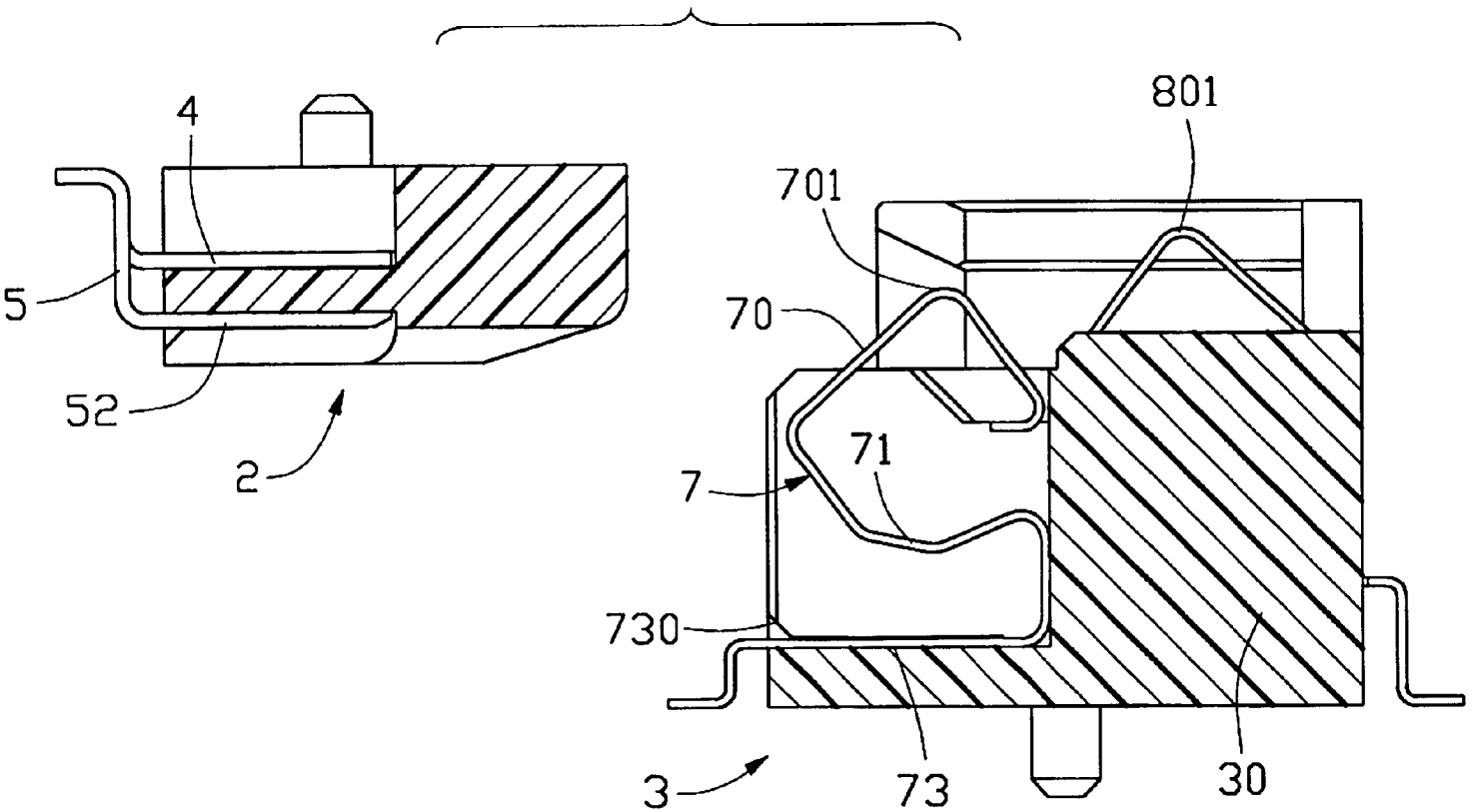
FIG. 4 is a cross-sectional view taken along line 4—4 of FIG. 1.

Referring to FIGS. 1 and 2, a battery connector assembly 1 in accordance with the present invention comprises a plug connector 2 and a receptacle connector 3 electrically mating with each other for transmitting electrical power and signals between a PCB and a PDA device (both not shown).

The plug connector 2 comprises an insulative plug housing 20 in a rectangular shape, and sets of first plug contacts 4 and second plug contacts 5 engageably received in the plug housing 20.

The housing 20 has a first side 22 and a second side 21 opposite to the first side 22. An elongate recess 23 is defined in the second side 21 and defines a row of openings 232 in a peripheral wall (not labeled) defining one side thereof. A pair of positioning posts 29 project from opposite ends of the second side 21 for engaging with the PCB. As is best seen in FIG. 2, the first side 22 of the housing 20 has a stepped shape and forms an upper plug step 25 and a lower plug step 28. The upper plug step 25 forms a row of elongate upper plug partitions 220 spaced apart from each other, and defines a row of upper plug slots 221 therebetween for receiving the set of second plug contacts 5. The lower plug step 28 forms a row of lower plug partitions 280 spaced apart from each other and defines a row of lower plug slots 281 therebetween for receiving the set of first plug contacts 4. Each lower plug slot 281 communicates with a corresponding opening 232 of the recess 23. The row of lower plug slots 281 is offset from the row of upper slots 221 by a half pitch of two adjacent first conductive plug contacts 4 in an elongate direction of the housing 20. Accordingly, the set of first plug contacts 4 is offset from the set of second plug contacts 5 by the half pitch in an elongate direction of the housing 20.

Additionally, two elongated indents 24 are defined in opposite ends of the first side 22. A guiding rib 241 protrudes into each indent 24 from an inward wall defining said indent 24. The guiding rib 241 forms a slanted tip surface 240 at a forward end thereof for guiding the receptacle connector 3 when mating it with the plug connector 2.

Each first plug contact 4 comprises a plug contact portion 42 which horizontally extends through a lower plug slot 281. A plug retaining portion 44 extends from the plug contact portion 42 through a corresponding opening 232 communicating with the lower plug slot 281, and abuts against a lower surface 234 of the recess 23. A solder portion 46 further extends from and perpendicular to the plug retaining portion 44 toward the second side 21, forming a horizontal solder tag 462 at its outer end. Each second plug contact 5 comprises a plug contact portion 52 extending through a corresponding upper plug slot 221, and a solder portion 54 extending perpendicularly from the plug contact portion 52 and toward the second side 21 to form into a horizontal solder tag 542. The plug contact portion 42 of each first plug contact 4 is located lower than the plug contact portion 52 of each second plug contact 5 with respect to the second side 21. The horizontal solder tags 462, 542 of the first and second plug contacts 4, 5 are coplanar with the second side 21 for soldering to the PCB using surface mounted technology (SMT).

The receptacle connector 3 comprises an insulative receptacle housing 30 in a rectangular shape and sets of first receptacle contacts 7 and second receptacle contacts 8 engagably received in the housing 30.

Figure 5:
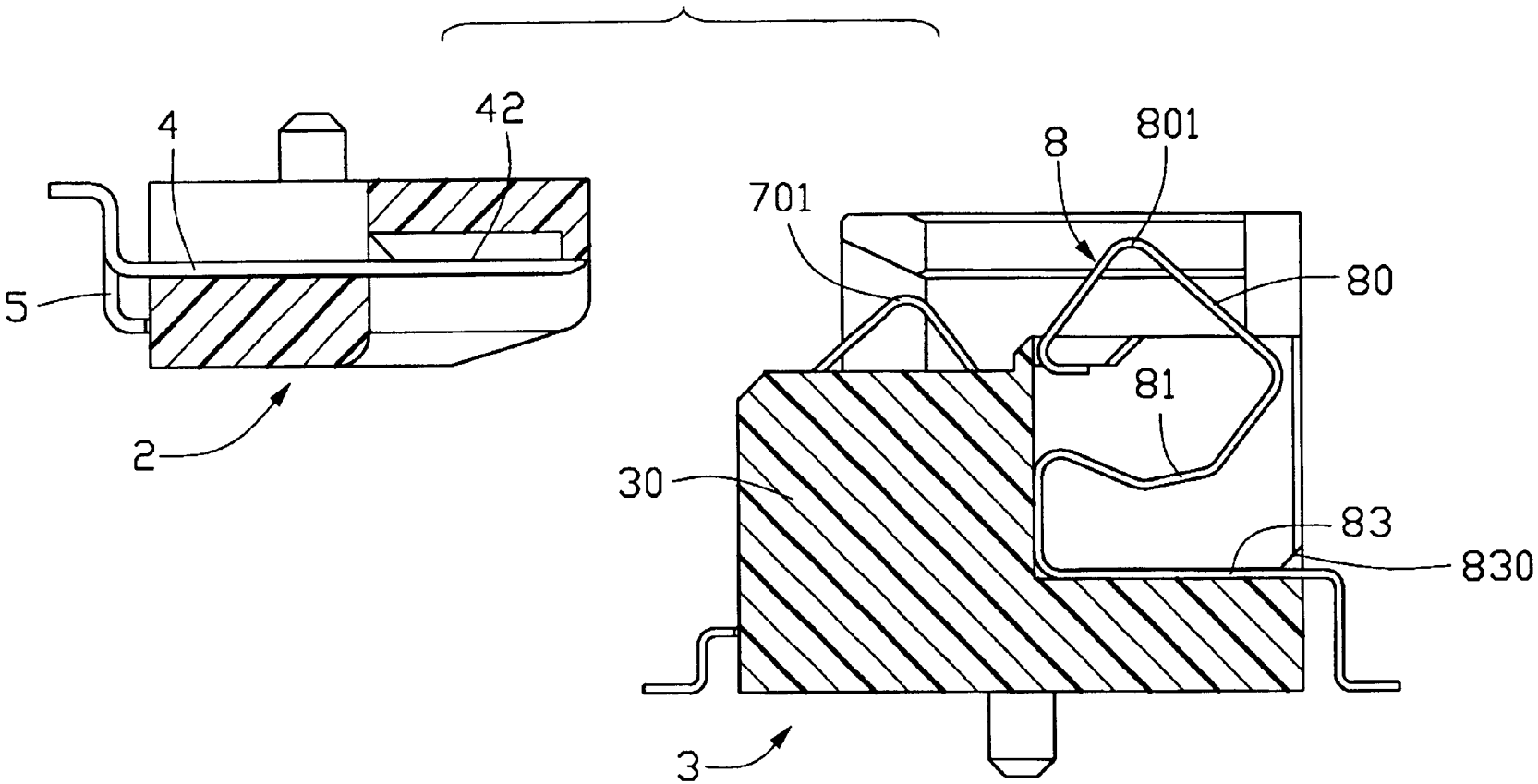
FIG. 5 is a cross-sectional view taken along line 5—5 of FIG. 1.
Figure 6:
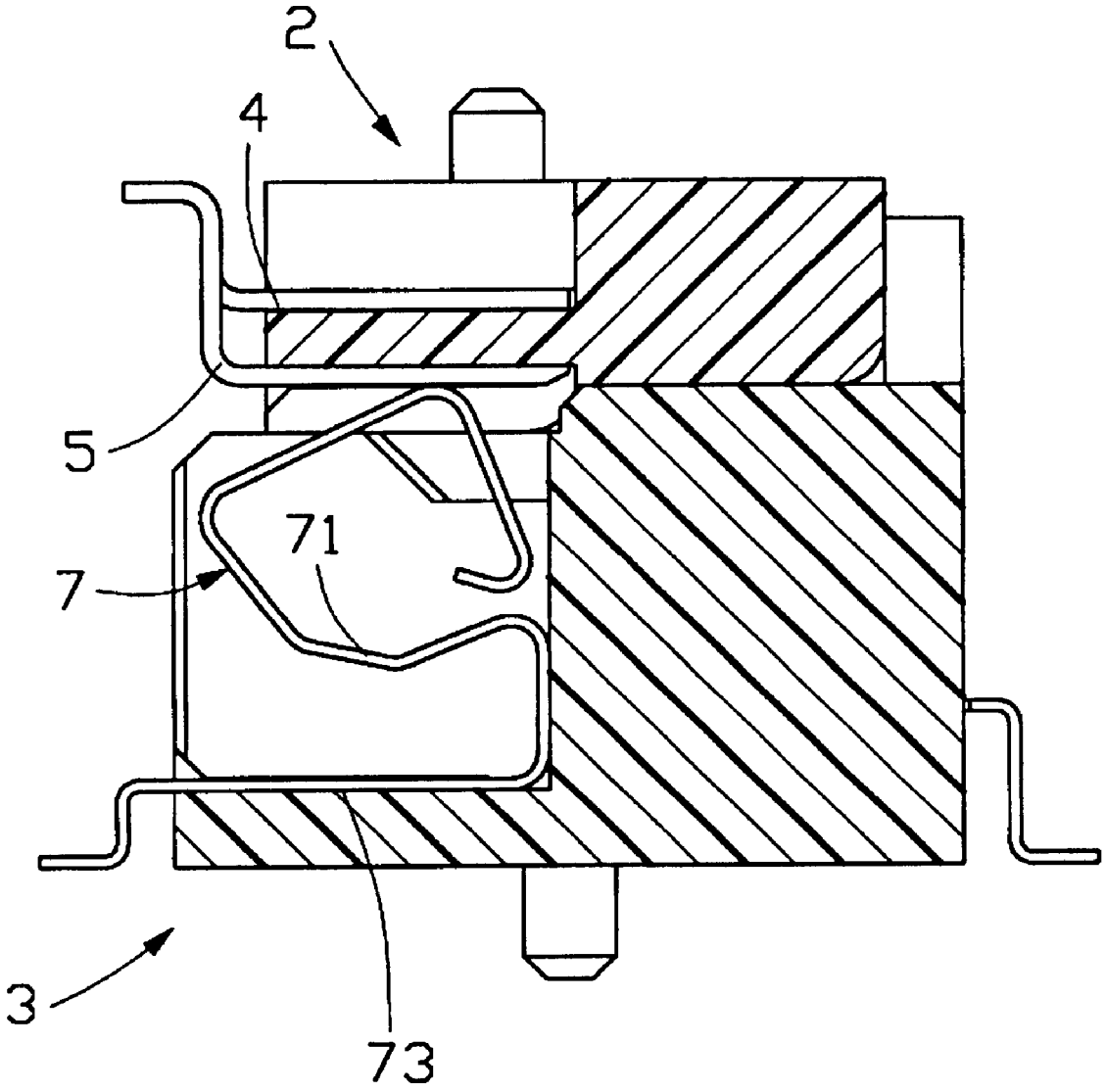
FIG. 6 is an assembled view of FIG. 4.
Figure 7:
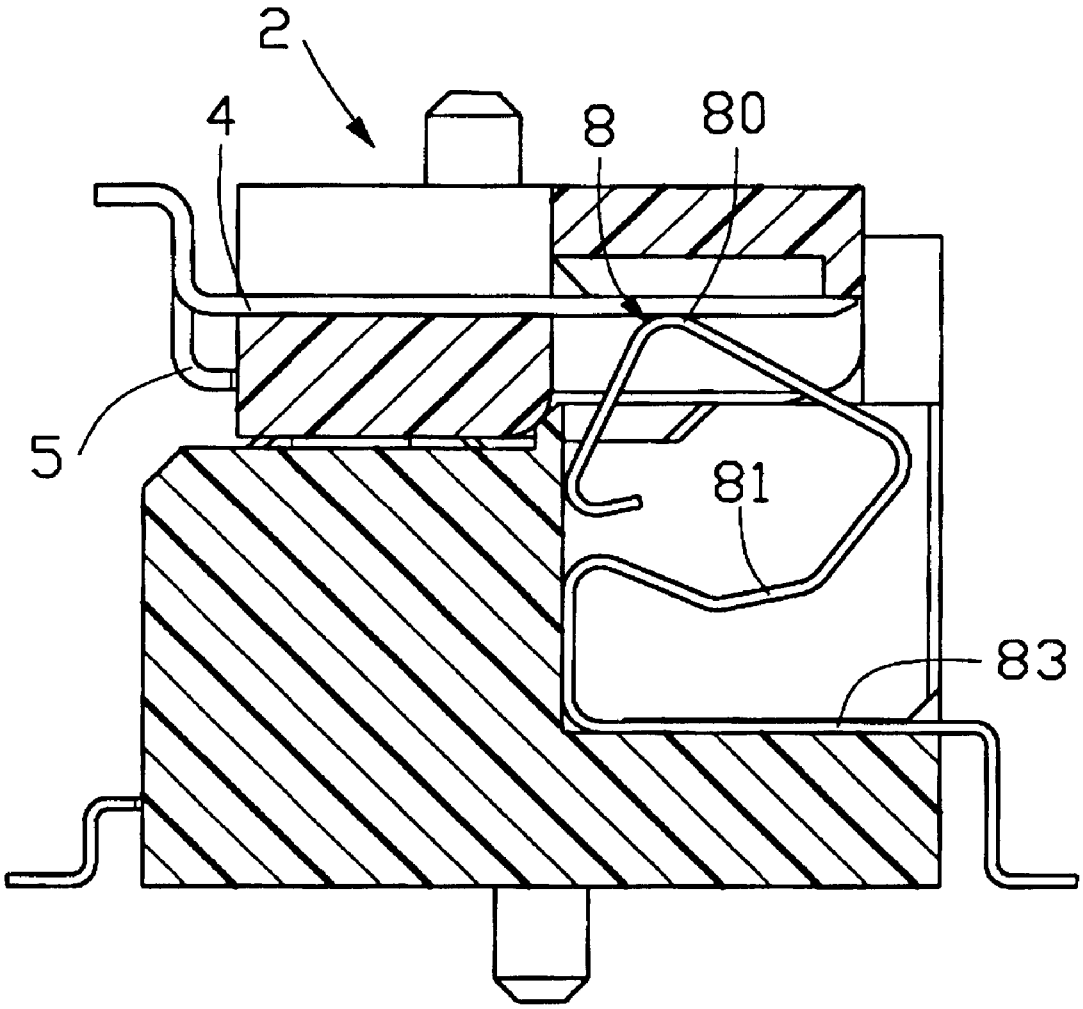
FIG. 7 is an assembled view of FIG. 5.
Figure 8:
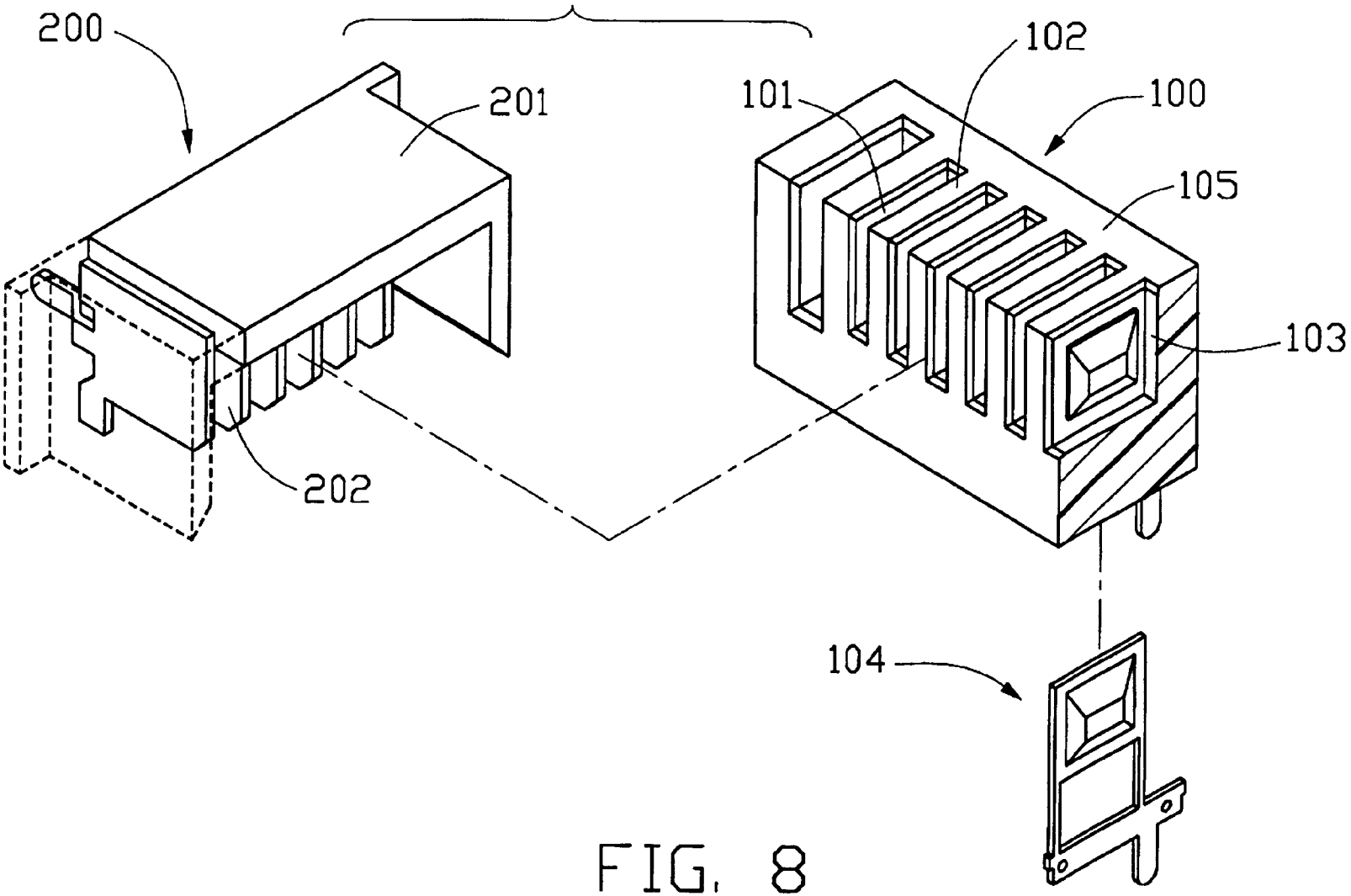
FIG. 8 (PRIOR ART)
FIG. 8 is an exploded, partially cut-away perspective view of a prior art battery connector assembly.

The housing 30 comprises a first side 81 and a second side 82 opposite to the first side 81. The first side 81 has a stepped shape and forms a lower receptacle step 86 and an upper receptacle step 88 which extend along opposite elongate sides of the first side 81. The lower and the upper receptacle steps 86, 88 respectively forms a row of lower and a row of upper receptacle partitions 810, 880 spaced apart from each other, and respectively define a row of lower and a row of upper receptacle slots 811, 881 therebetween for receiving the sets of first and second receptacle contacts 7, 8, respectively. Consistent with the structure of the plug connector 2, the row of lower receptacle slots 811 is offset from the row of upper receptacle slots 881 by a half a pitch of two adjacent first receptacle contacts 7 in an elongate direction of the housing 30. Accordingly, the set of first receptacle contacts 7 is offset from the set of second receptacle contacts 8 by the half pitch in the elongate direction of the housing 30. Note that the distance between adjacent upper plug slots 221, adjacent lower plug slots 281, adjacent lower receptacle slots 811, and adjacent upper receptacle slots 881 are all equal. The pitch between the contacts 4, 5, 7 and 8 are thus also equal, and the amount of offset between sets of contacts 4 and 5, and 7 and 8, is also equal. Each lower and each upper receptacle slot 811, 881 defines a notch 730, 830 (FIG. 5) at a lower end thereof. In addition, two latching members 300 project from opposite ends of the first side 81 for engaging with the two indents 24 of the housing 20 of the plug connector 2.

Referring to FIGS. 1 and 3–5, the first and second receptacle contacts 7, 8 are similar in structure and are now described below. Each first/second receptacle contact 7/8 comprises a resilient portion 71/81, a receptacle contact portion 70/80 generally extending upward from one end of the resilient portion 71/81, and a receptacle retaining portion 73/83 generally extending downward from the other end of the resilient portion 71/81 and interferingly retained in the housing 30. The receptacle contact portion 70/80 forms an apex 701/801 for contacting with a corresponding plug contact portion 52/42 of the second and first plug contact 5/4 of the plug connector 2. The apex 701 of each first receptacle contact 7 extends lower than the apex 801 of each second receptacle contact 8 with respect to an outer surface 821 of the second side 82 of the receptacle connector 3.

In assembly, referring to FIGS. 1 to 7, the plug contact portions 42, 52 of the first and second plug contacts 4, 5 are engaged within the lower and upper slots 281, 221 of the housing 20, respectively. The plug retaining portions 44 of the first plug contacts 4 extend through respective openings 232 and abut against a bottom surface 234 of the recess 23. The plug connector 2 is mounted onto the PCB by the positioning posts 29 thereof being retained in two holes (not shown) defined in the PCB, and the solder tags 462, 542 of the first and second plug contacts 4, 5 are soldered to the PCB by SMT. The first and second receptacle contacts 7, 8 are engaged within the rows of lower and upper receptacle slots 811, 881 of the housing 30, respectively, with the retaining portions 73, 83 thereof retained in the notches 730 and 830 (FIG. 5), respectively. The receptacle connector 3 is then attached to the PDA device.

In use, the plug connector 2 is mated with the receptacle connector 3 with the indents 24 of the plug connector 2 engaging with the latching members 300 of the receptacle connector 3. Meanwhile, the first and second plug contacts 4, 5 of the plug connector 2 are mated with corresponding second and first receptacle contacts 8, 7 of the receptacle connector 3, respectively. During mating, the row of lower plug partitions 280 of the plug connector 2 unavoidably slide over the set of corresponding first receptacle contacts 7 of the receptacle connector 3 because of their offset, but cannot damage them because they do not extend higher than the set of second plug contacts 5. Furthermore, the first plug contacts 4 of the plug connector 2 cannot contact with the first receptacle contacts 7 of the receptacle connector 3 because the row of first receptacle contacts 7 are horizontally offset by a half pitch from the row of second receptacle contacts 8 and thus from the row of first plug contacts 4, thereby ensuring a safe and effective electrical connection between corresponding plug contacts and receptacle contacts for transmitting electrical power and signals between the PCB and the PDA device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector assembly, comprising:

a plug connector comprising:

an insulative housing having a first side having a generally stepped shape and a second side opposite to the first side, said first side defining a first row of slots and a second row of slots, and a set of conductive first plug contacts and a set of conductive second plug contacts being received in the first and second rows of slots, respectively, each of the first and the second contacts to comprising a contact portion, the contact portions of the set of first and the set of second contacts being spaced a different distance from the second side of the housing; and a receptacle connector mateable with the plug connector, said receptacle connector comprising:

an insulative housing having a first side having a generally stepped shape and a second side opposite to the first side, said first side defining a first row of slots and a second row of slots, and a set of conductive first receptacle contacts and a set of conductive second receptacle contacts being respectively received in the first row of slots and in the second row of slots of the receptacle connector, respectively, and being engageable with the set of conductive second plug contacts and the set of conductive first plug contacts of the plug connector, respectively:

wherein the first side of the housing of the plug connector forms a lower step and an upper step, and the first row of slots and the second row of slots are respectively defined in the lower step and in the upper step;

wherein the lower and upper steps of the plug connector comprise a row of lower partitions and a row of upper partitions, respectively, for separating the slots in the first row of slots and the slots in the second row of slots from each other;

wherein the slots in the first row of slots in the lower step are offset from the slots in the second row of slots in the upper step by a distance of a half pitch, where a pitch is the distance between two adjacent first plug contacts;

wherein the first side of the plug connector defines two elongate indents at opposite ends thereof, and wherein the first side of the receptacle connector forms two latching members at opposite ends thereof for engaging within the indents of the plug connector;

wherein the housing of the plug connector forms a guiding rib projecting into each indent thereof and the guiding rib forms a slanted tip surface at an end thereof for guiding the latching members of the receptacle connector to mate with the indents of the plug connector;

wherein the second side of the housing of the plug connector defines a recess along one side thereof;

wherein a plurality of openings are defined in a peripheral wall defining one side of the recess and the set of first contacts of the plug connector extend through corresponding openings and abut against a lower surface of the recess;

wherein the first and second plug contacts of the plug connector form horizontal solder tags coplanar with the second side of the housing of the plug connector for soldering to a printed circuit board using surface mount technology;

wherein the first side of the housing of the receptacle connector forms a lower step and an upper step both extending along elongate sides thereof;

wherein the lower and upper steps of the receptacle connector comprise a row of lower partitions and a row of upper partitions, respectively, for respectively separating the first row of slots from each other and the second row of slots from each other;

wherein the slots in the first row of slots of the receptacle connector are offset from the slots in the second row of slots thereof by a distance of half a pitch, where a pitch is the distance between two adjacent first receptacle contacts;

wherein a notch is defined in a lower end of each slot of the receptacle connector for retaining a first receptacle contact or a second receptacle contact;

wherein each first receptacle contact and each second receptacle contact have a similar structure and each comprises a resilient portion, a contact portion extending from one end of the resilient portion and a retaining portion extending from the other end of the resilient portion;

wherein the contact portion of each first contact forms an apex at an uppermost point of the first contact, which extends a shorter distance from the second side of the receptacle connector than does an apex formed by the contact portion at an uppermost point of each second contact.

* * * * *